US010688816B2

(12) United States Patent
Martellono

(10) Patent No.: US 10,688,816 B2
(45) Date of Patent: Jun. 23, 2020

(54) HEATED ROLLER, IN PARTICULAR FOR A TEXTILE PRINTER, AND TEXTILE PRINTER COMPRISING THIS ROLLER

(71) Applicant: ATPCOLOR S.r.l., Senago (Milan) (IT)

(72) Inventor: Roberto Maria Martellono, Cerano (IT)

(73) Assignee: ATPCOLOR S.R.L., Senago (Milan) (IT)

( * ) Notice: Subject to any disclaimer, the term of this patent is extended or adjusted under 35 U.S.C. 154(b) by 0 days.

(21) Appl. No.: 16/160,069

(22) Filed: Oct. 15, 2018

(65) Prior Publication Data

US 2019/0118560 A1 Apr. 25, 2019

(30) Foreign Application Priority Data

Oct. 20, 2017 (IT) ..... 102017000118834

(51) Int. Cl.
*B41J 15/04* (2006.01)
*B41J 11/00* (2006.01)
(Continued)

(52) U.S. Cl.
CPC ..... *B41J 15/04* (2013.01); *B41F 16/02* (2013.01); *B41F 23/042* (2013.01);
(Continued)

(58) Field of Classification Search
CPC ... B41J 2/01; B41J 2/211; B41J 2/1433; B41J 2/17; B41J 2/17593; B41J 2/2107; B41J 2/1755; B41J 2/2114; B41J 2/2117; B41J 2/2056; B41J 2/21; B41J 2/0057; B41J 3/60; B41J 2002/012; B41J 2/04598; B41J 2/04588; B41J 2/04595; B41J 2/04586; B41J 2/14274; B41J 11/0015; B41J 11/002; B41J 2/161; B41J 2/1623; B41J 2202/00; B41J 2202/03; B41J 2/14201; B41J 2/045; C09D 11/36; C09D 11/40; C09D 11/30; C09D 11/38; C09D 11/32; C09D 11/322;
(Continued)

(56) References Cited

U.S. PATENT DOCUMENTS 2,047,372 A 7/1936 Jalens
9,352,588 B1 5/2016 Boland et al.
(Continued)

OTHER PUBLICATIONS

Italian Search Report and Written Opinion dated Mar. 22, 2018 for Application No. IT201700118834.

*Primary Examiner* — Manish S Shah
(74) *Attorney, Agent, or Firm* — Patterson + Sheridan, LLP

(57) ABSTRACT

A heated roller, in particular for a textile printer, comprising: a pair of stationary supports, an elongated tubular element located between said stationary supports and rotatably carried by said stationary supports about a longitudinal axis, a stationary infrared lamp extending inside said tubular element and having opposite ends supported by said stationary supports, a lamp support device extending between said stationary supports inside said tubular element and supporting the infrared lamp between said stationary supports, and an elastic device which applies an elastic tension to said lamp support device between said stationary supports in the direction of said longitudinal axis.

9 Claims, 7 Drawing Sheets

(51) Int. Cl.

| | |
|---|---|
| ***B41J 3/407*** | (2006.01) |
| ***B41F 23/04*** | (2006.01) |
| ***B65H 27/00*** | (2006.01) |
| ***B41F 16/02*** | (2006.01) |

(52) U.S. Cl.
CPC ..... *B41F 23/0413* (2013.01); *B41F 23/0436* (2013.01); *B41J 3/4078* (2013.01); *B41J 11/002* (2013.01); *B65H 27/00* (2013.01); *B65H 2301/517* (2013.01); *B65H 2301/5143* (2013.01); *B65H 2404/16* (2013.01); *B65H 2557/512* (2013.01); *B65H 2701/174* (2013.01)

(58) Field of Classification Search
CPC ... C09D 11/324; C09D 11/328; C09D 11/101; C09D 11/102; C09D 11/005; C09D 11/54; C09D 11/52; B41M 5/0011; B41M 5/0017; B41M 5/0047; B41M 7/00; B41M 7/0072; B41M 5/52; B41M 5/5218; G03G 15/2039; G03G 15/2053
See application file for complete search history.

(56) References Cited

U.S. PATENT DOCUMENTS

| | | | | |
|---|---|---|---|---|
| 2004/0189773 | A1 | 9/2004 | Masumi et al. | |
| 2007/0122173 | A1* | 5/2007 | Mitsuoka | G03G 15/2039 399/69 |
| 2009/0219328 | A1* | 9/2009 | Godil | B41J 2/0057 347/19 |
| 2009/0245844 | A1* | 10/2009 | Tsueda | G03G 15/2039 399/69 |
| 2010/0232822 | A1* | 9/2010 | Takenaka | G03G 15/2053 399/69 |
| 2011/0228289 | A1* | 9/2011 | Yamamoto | B41J 11/002 358/1.8 |

* cited by examiner 62
68
66
46
66

42
46
46
62
68
66
66
64
64
VIII
VIII
A

HEATED ROLLER, IN PARTICULAR FOR A TEXTILE PRINTER, AND TEXTILE PRINTER COMPRISING THIS ROLLER

CROSS-REFERENCE TO RELATED APPLICATIONS

This application claims benefit of Italian patent application number 102017000118834, filed Oct. 20, 2017 which is herein incorporated by reference.

BACKGROUND OF THE INVENTION

Field of the Invention

The present invention relates in general to textile printers for digital printing on fabrics.

More particularly, the invention relates to a heated roller, designed in particular to be used in a textile printer.

Description of Prior Art

In digital printing on fabrics, thermosetting of the inks on the fabric may be necessary. In these cases, it is common to use a thermosetting unit comprising a plurality of rollers through which the fabric is passed downstream of the printing unit. The thermosetting unit can be an integral part of the textile printer (in-line thermosetting) or it can be a separate apparatus with respect to the textile printer. The thermosetting unit can be provided with at least one heated roller, having an outer surface heated to temperatures that can reach up to 200° C.

The heating of a roller can be obtained by means of a heating circuit using a diathermic fluid circulating inside the heated roller. Heated rollers comprising infrared lamps as heating elements are also common.

The heating of the rollers by means of infrared lamps offers considerable advantages with respect to heating systems using diathermic fluids, especially in that they do not require a circuit for heating and circulation of the diathermic fluid inside the roller.

An infrared lamp for heating a heated roller generally comprises a quartz crystal body in which an electrical resistance is inserted which emits infrared light. The infrared lamp extends along the entire length of the heated roller and is supported at its ends outside the heated roller. The infrared lamp reaches temperatures on the surface of the quartz crystal body that can exceed 700° C. The quartz crystal also becomes less rigid at these temperatures. The infrared lamp, being supported only at its ends, can bend under the action of its own weight.

A limitation of heating systems with heated rollers using infrared lamps is that when the lamp has a length greater than 2 m it tends to bend and the bending of the lamp may cause it to break.

SUMMARY OF THE INVENTION

The present invention aims to provide a heated roller that overcomes the problems of the prior art.

According to the present invention, this object is achieved by a heated roller having the characteristics disclosed herein.

The claims form an integral part of the disclosure provided here in relation to the invention.

BRIEF DESCRIPTION OF THE DRAWINGS

The present invention will now be described in detail with reference to the attached drawings, given purely by way of non-limiting example, wherein.

It will be appreciated that, for clarity and simplicity of illustration, the various figures may not be reproduced on the same scale.

DETAILED DESCRIPTION

Figure 1:
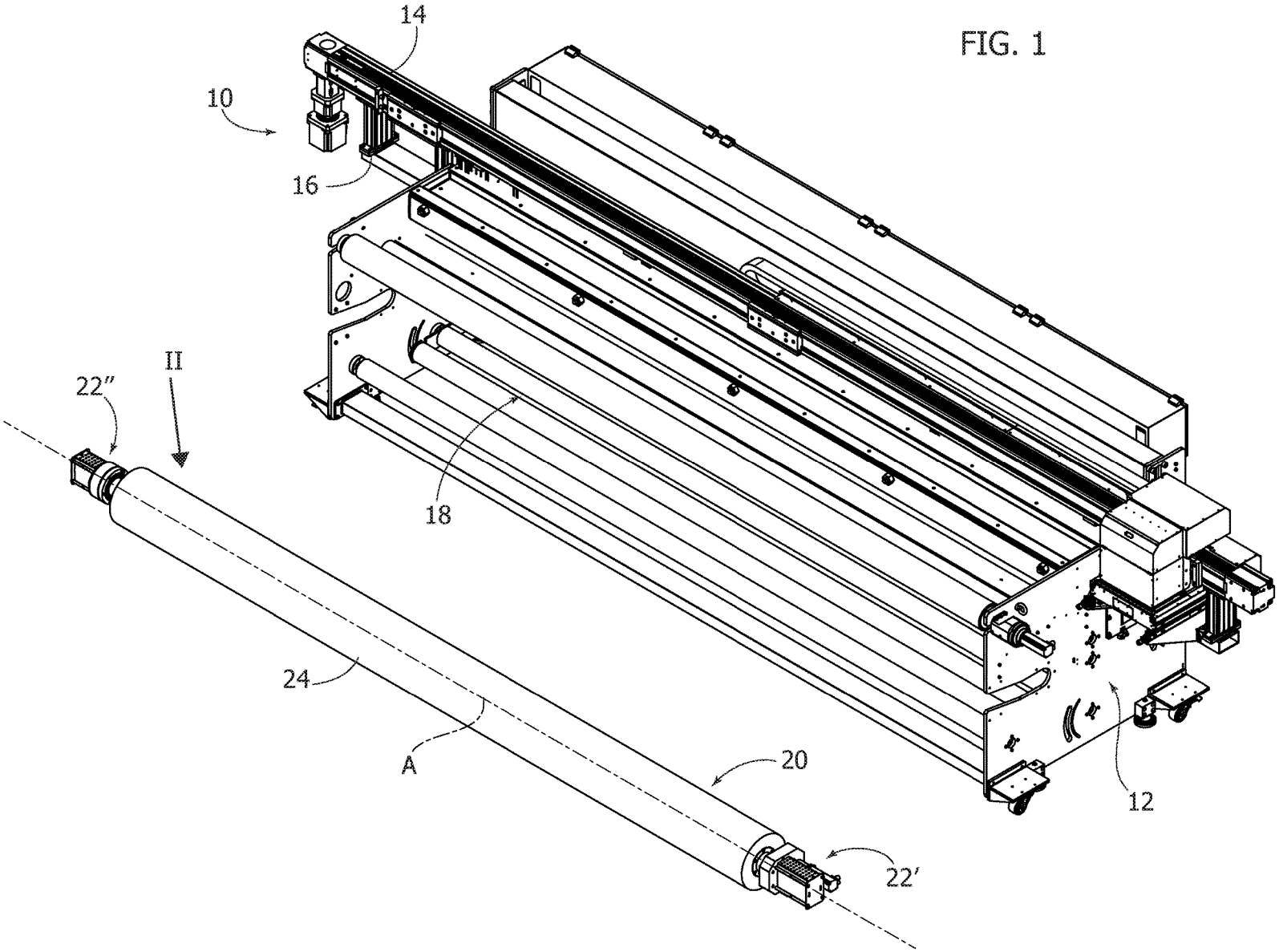
FIG. 1 is a partially exploded perspective view of a textile printer provided with a heated roller.

With reference to FIG. 1, numeral 10 indicates a textile printer for digital printing on fabrics. The textile printer 10 comprises a stationary frame 12 carrying a horizontal bar 14 along which a printing head 16 is movable.

In the illustrated embodiment, the textile printer 10 comprises a thermosetting assembly 18 for thermosetting the inks onto the fabric. The thermosetting assembly 18 comprises a heated roller 20, shown in an exploded position in the representation of FIG. 1.

With reference to FIGS. 1-4, the heated roller 20 comprises a pair of stationary supports 22', 22" and an elongated tubular element 24 located between the stationary supports 22', 22". The two stationary supports 22', 22" are fastened to respective sides of the frame 12. The elongated tubular element 24 is rotatably carried by the supports 22', 22" about a longitudinal axis A.

Figure 5:
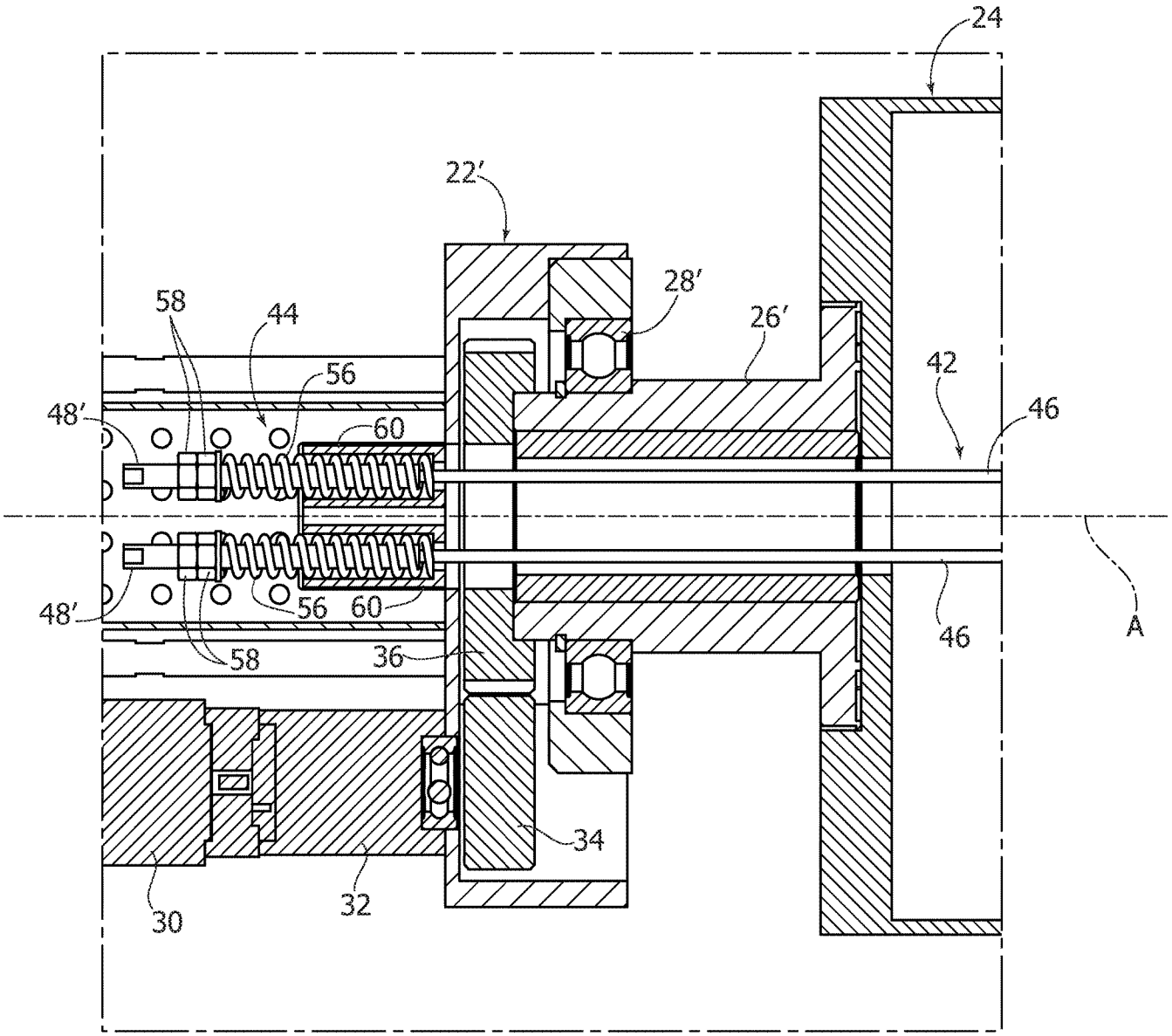
FIGS. 5 and 6 are enlarged axial cross-sections of the parts indicated by the arrows V and VI in FIGS. 3 and 4.
Figure 6:
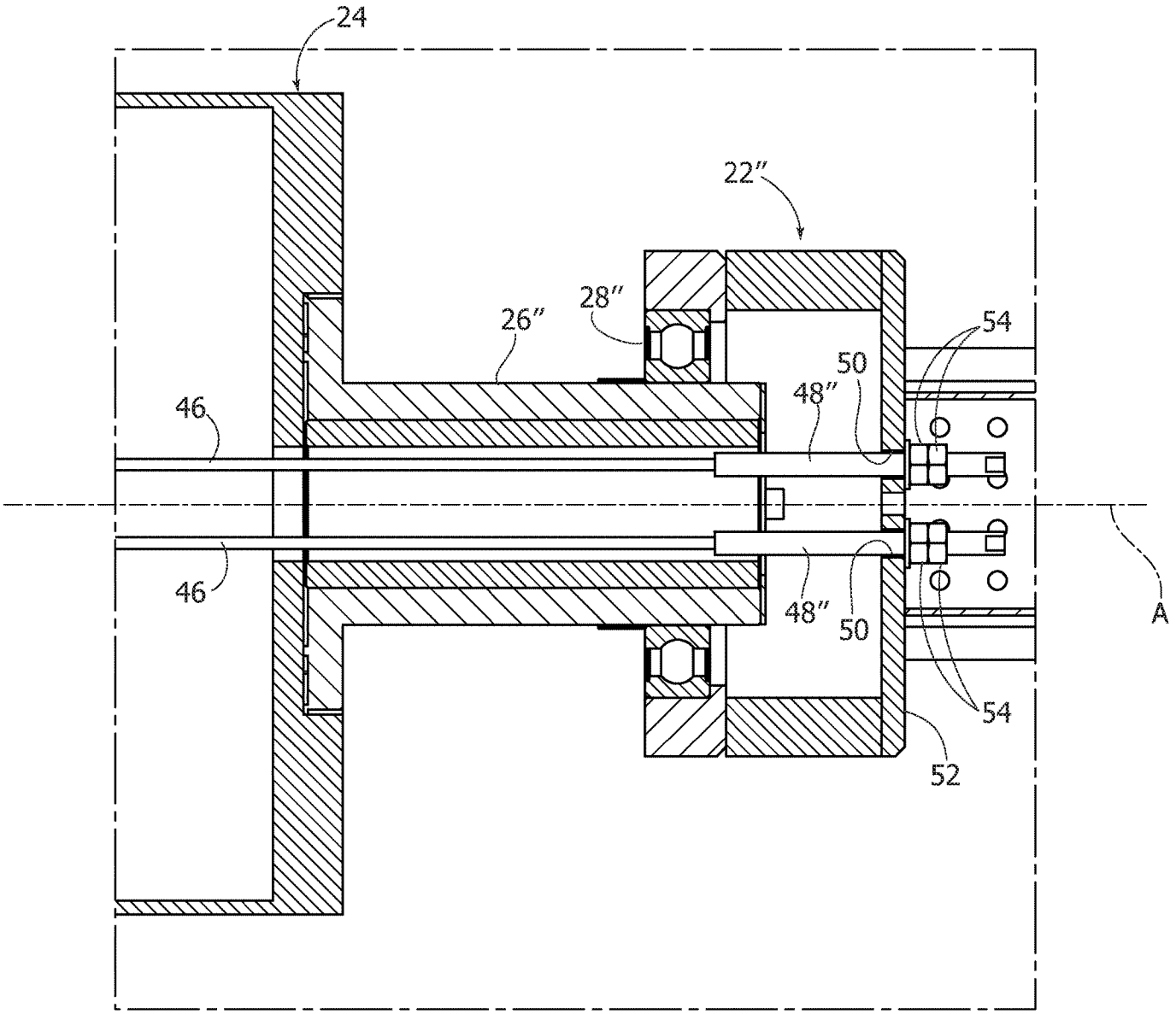

As illustrated in greater detail in FIGS. 5 and 6, the elongated tubular element 24 carries two hollow pins 26', 26" at its ends, which are rotatably supported about the axis A by the respective stationary supports 22', 22" by means of respective bearings 28', 28". The first support 22' may carry an electric motor 30 associated with a gearbox 32, for example a planetary gear, which rotates the elongated tubular element 24 about the axis A by means of a pair of gears 34, 36.

Figure 2:
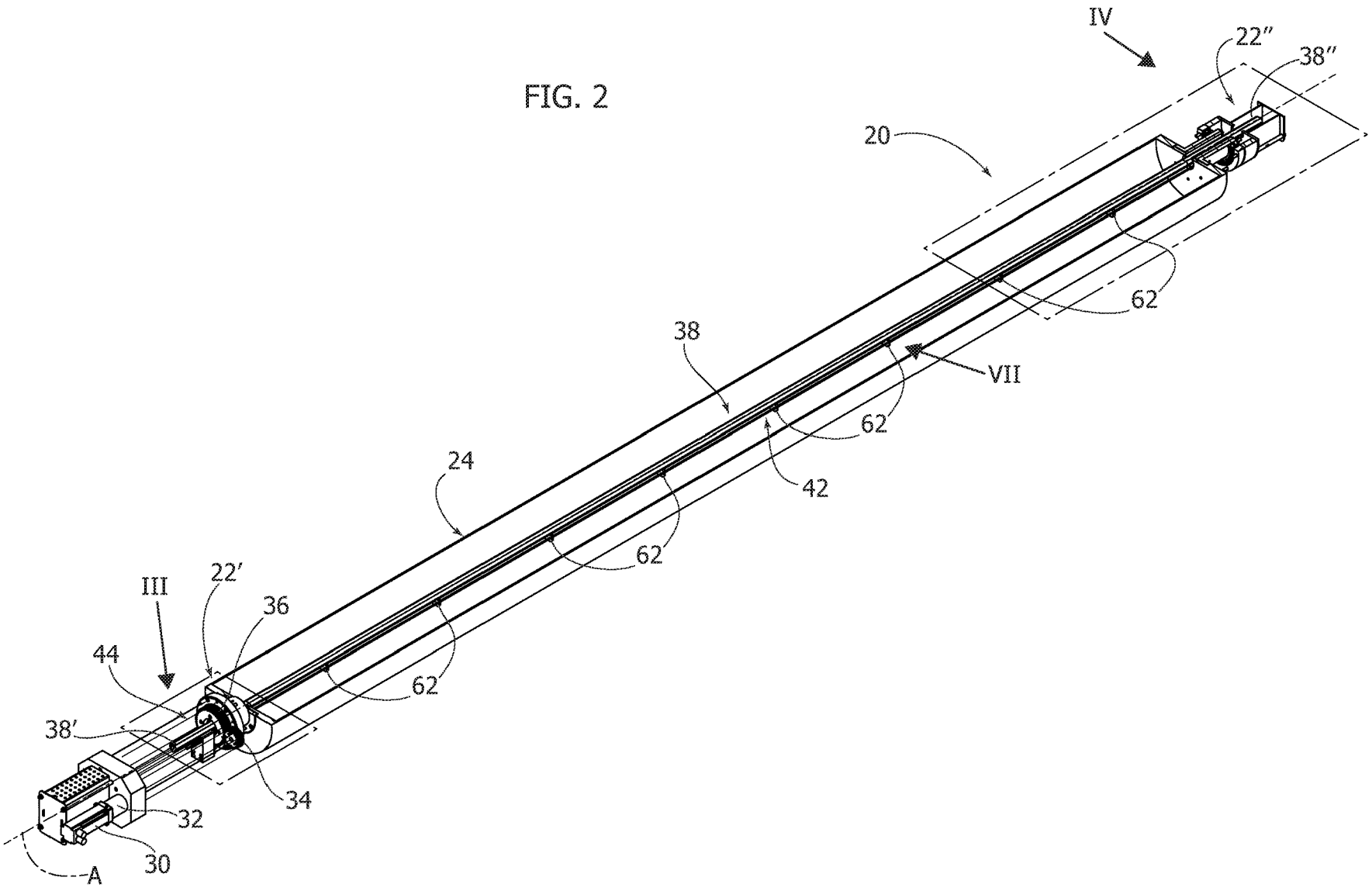
FIG. 2 is a perspective view in cross-section of the heated roller indicated by the arrow II in FIG. 1.
Figure 3:
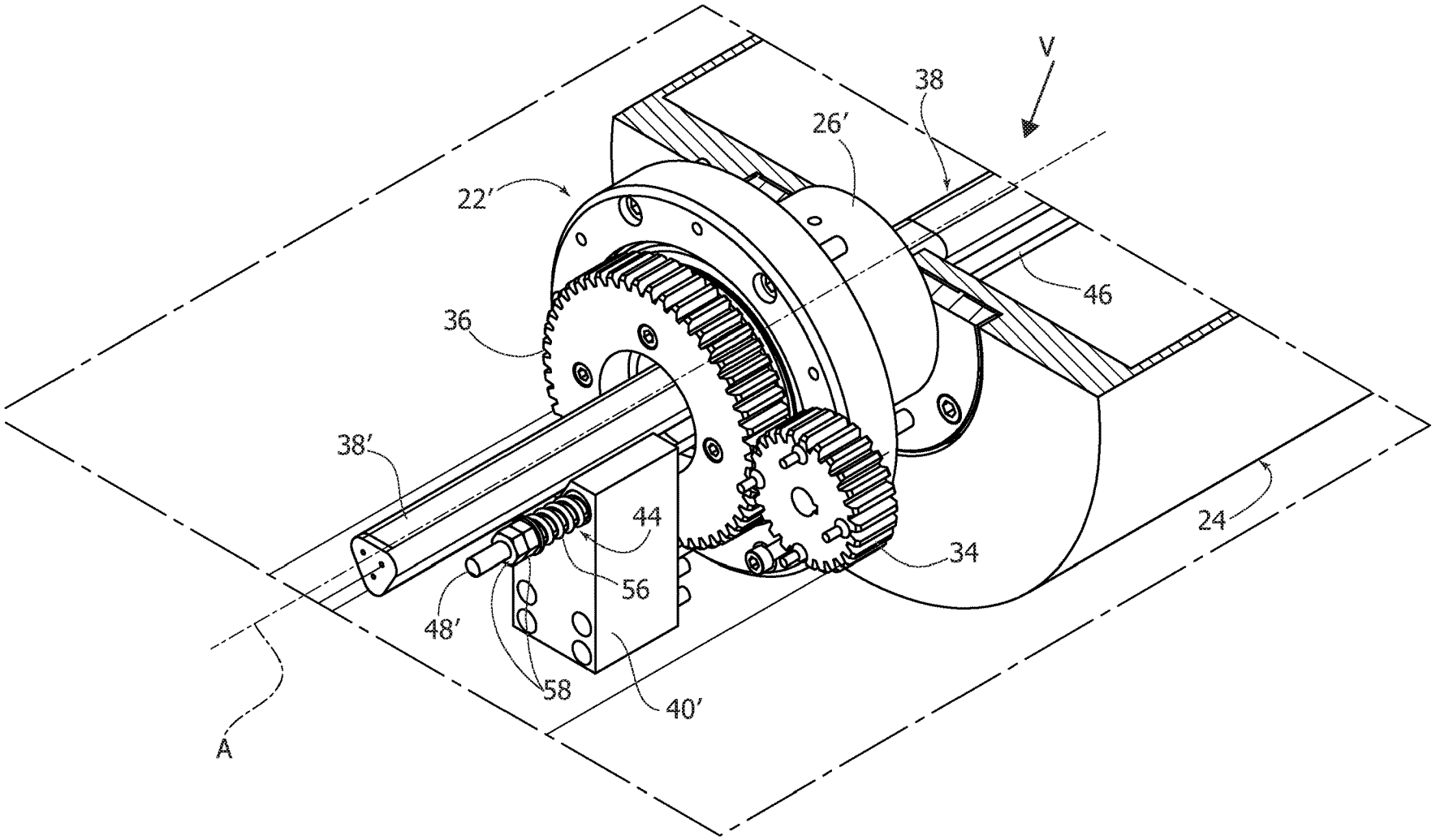
FIGS. 3 and 4 are perspective views in cross-section illustrating the parts indicated by arrows III and IV in FIG. 2 on an enlarged scale.
Figure 4:
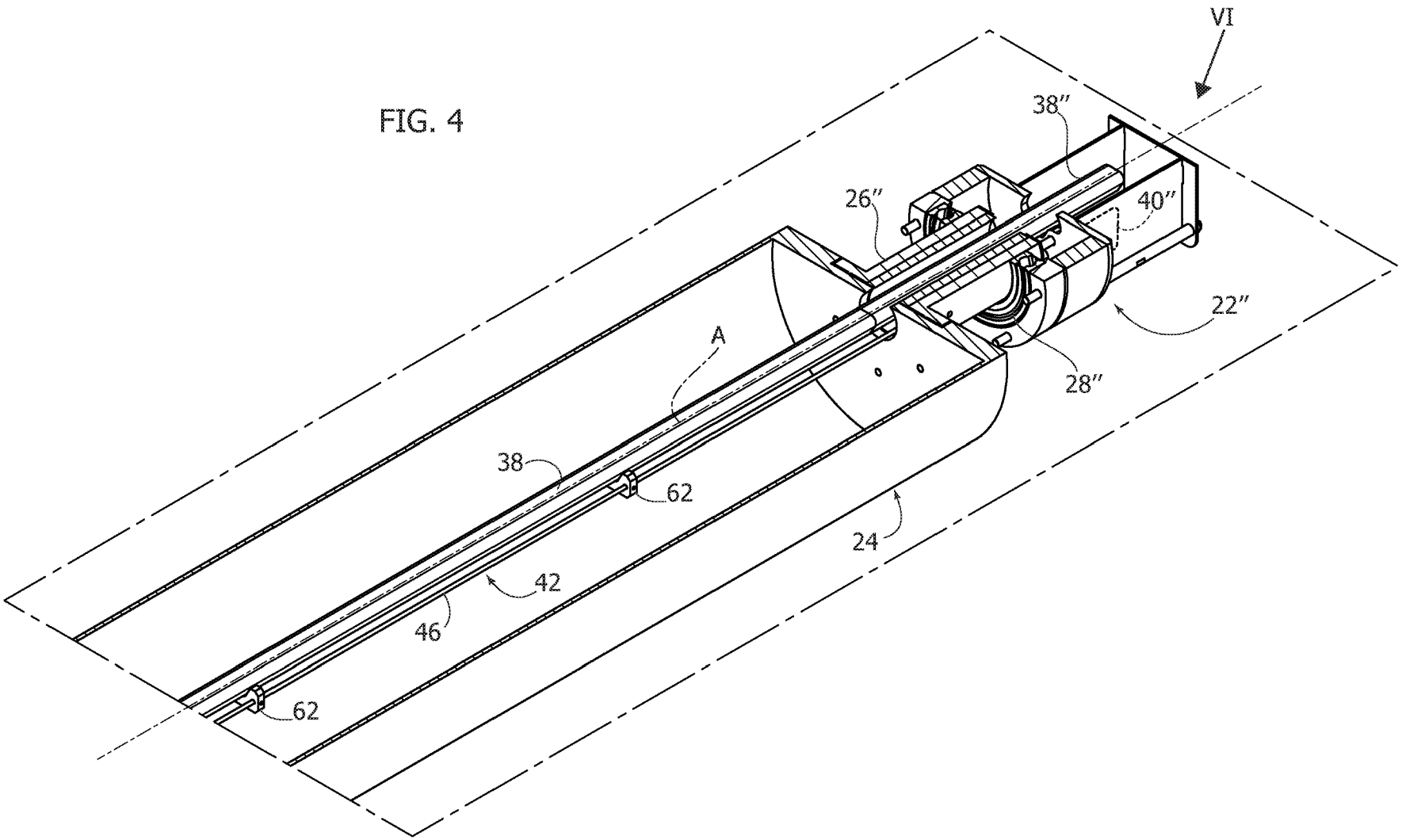

With reference to FIGS. 2, 3 and 4, the roller 20 comprises an infrared lamp 38 which extends inside the tubular element 24. The infrared lamp 38 is fixed with respect to the stationary supports 22', 22". The infrared lamp 38 extends along the longitudinal axis A and has a length greater than the length of the tubular element 24. The infrared lamp 38 has two ends 38', 38" which protrude laterally to the outside of the tubular element 24. The ends 38', 38" of the infrared lamp 38 pass through respective hollow pins 26', 26". The infrared lamp 38 comprises a quartz crystal body in which a resistor extends that emits infrared radiation when it is supplied with an electric current. The resistor extends in the part of the infrared lamp 38 contained within the tubular element 24. The ends 38', 38" of the infrared lamp 38 can be without a resistor to avoid heating the supports 22', 22". The ends 38', 38" of the infrared lamp 38 rest on respective bases 40', 40" forming part of the respective stationary supports 22', 22". During operation, the infrared lamp 38 remains stationary and the tubular element 24 rotates about the infrared lamp 38. The inner wall of the tubular element 24 is heated by radiation due to the infrared radiation emitted by the infrared lamp 38.

During operation, the infrared lamp 38 reaches very high operating temperatures (close to 700° C.). The infrared lamp 38 may be very long, for example, greater than 2 m. Considering the high length and the high operating temperature, the part of the infrared lamp 38 included between the two stationary supports 22', 22" is subjected to bending, which could cause the lamp to break.

To overcome this problem, the heated roller 24 comprises a lamp support device 42 which extends between the stationary supports 22', 22" within the tubular element 24, and which supports the portion of the infrared lamp 38 located inside the tubular element 24. In this way, the infrared lamp 38, instead of being supported only at its ends 38', 38", is also sustained and supported in the portion that extends inside the tubular element 24.

During operation, the lamp support device 42 undergoes thermal expansion due to the high temperature produced by the infrared lamp 38. The lamp support device 42 would therefore tend to bend inside the tubular element 24. In order to avoid bending of the lamp support device 42 due to thermal expansion, the heated roller 20 comprises an elastic device 44 which applies an elastic tension to the lamp support device 42, which acts between the stationary supports 22', 22" in the direction of the longitudinal axis A. The elastic tensioning of the lamp support device 42 ensures the absence of bending of the lamp support device 42 due to thermal expansion. In fact, the increase in length of the lamp support device 42 due to the temperature increase is recovered by the elastic device. In this way, the lamp support device 42 remains without deformations even at the high operating temperatures of the infrared lamp 38. Consequently, the infrared lamp 38 can be supported inside the tubular element 24, and bending of the infrared lamp 38 and the consequent risks of breakage are avoided.

A possible embodiment of the lamp support device 42 and of the elastic device 44 will be described below. It is understood that the embodiment described constitutes only one of the possible embodiments of the present invention. The lamp support device 42 and the elastic device 44 which applies the elastic tensioning to the lamp support device 42 may vary with respect to the embodiment shown in the figures without departing from the scope of the present invention.

With reference to FIGS. 5 and 6, in one embodiment the lamp support device 42 comprises two metal cables 46, for example made of steel, parallel to each other and parallel to the longitudinal axis A. The cables 46 extend for the entire length of the tubular element 24. The opposite ends of the cables 46 extend through respective hollow pins 26', 26" of the tubular element 24. As illustrated in FIG. 5, first ends of the cables 46 are connected to the first support 22' by the elastic device 44. With reference to FIG. 6, second ends of the cables 46 are anchored to the second stationary support 22". In the example shown in the figures, the ends of each cable 46 are fixed to two threaded cable terminals 48', 48". The cable terminals 48" pass through respective holes 50 formed in a wall 52 of the second stationary support 22" and engage respective nuts 54 which rest on the outer face of the wall 52.

As shown in FIG. 5, the elastic device 44 comprises two compression coil springs 56 which extend coaxially to the respective cable terminals 48'. Respective nuts 58 are screwed on the cable terminals 48', which axially compress the helical springs 56 against a wall of the first stationary support 22'. The elastic device 44 may comprise two tubular guides 60 that are fixed with respect to the first stationary support 22', which contain and guide the springs 56. The springs 56 are compressed between the tubular guides 60, fixed with respect to the first stationary support 22', and the nuts 58 screwed onto the cable terminals 48' of the cables 46. The elastic force of the springs 56 produces a tensioning of the cables 46 between the two stationary supports 22', 22".

Figures 7, 8:
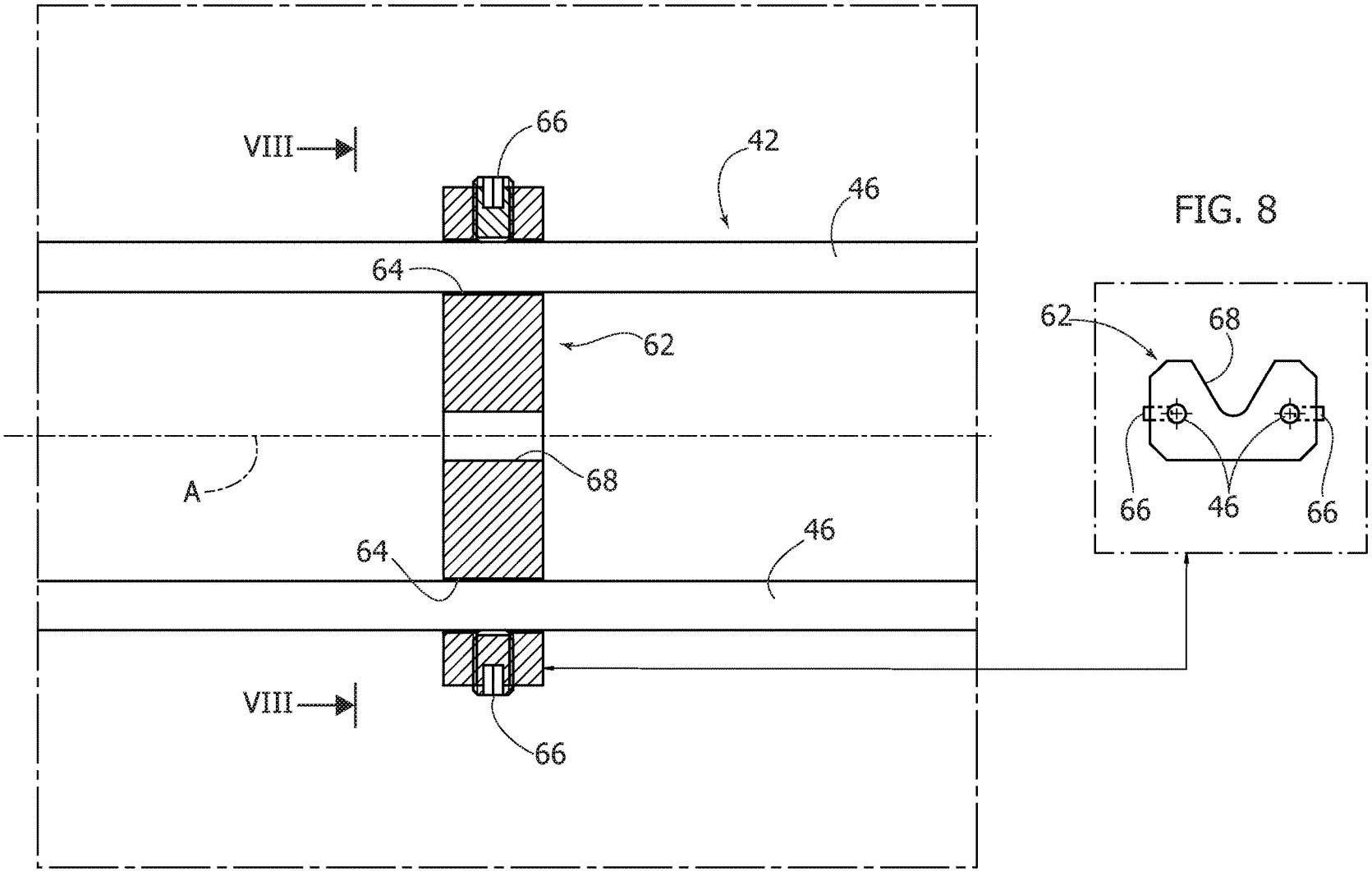
FIG. 7 is an enlarged detail of the part indicated by the arrow VII in FIG. 2.
FIG. 8 is a cross-section along the line VIII-VIII of FIG. 7.

With reference to FIGS. 7 and 8, the lamp support device 42 comprises a plurality of support elements 62, each of which is fixed to the two cables 46. Each support element 62 can be in the form of a thin plate, provided with two through-holes 64 through which respective cables 46 extend. Each support element 62 can be provided with two threaded pins 66 which engage respective threaded transverse holes and which press on the respective cables 46 to fasten the support element 62 to the cables 46. The support elements 62 are spaced apart along the longitudinal axis A and are provided with respective seats 68 in which the infrared lamp 38 rests. The seats 68 may have a V-shape corresponding to the cross-sectional profile of the infrared lamp 38.

Thus, the infrared lamp 38 in the portion extending inside the tubular element 24 rests on a plurality of support elements 62 distributed along the entire length of the infrared lamp 38. The support elements 62 are fastened to the cables 46, which are elastically tensioned between the stationary supports 22', 22". Therefore, the cables 46, due to the elastic tensioning produced by the elastic device 46, do not bend even at high temperatures since the thermal expansion of the cables 46 is compensated by the springs 56 of the elastic device 44. As a result, bending of the infrared lamp 38 is effectively avoided, even in the case of extremely long lamps.

Of course, without prejudice to the principle of the invention, the details of construction and the embodiments may be widely varied with respect to those described and illustrated, without thereby departing from the scope of the invention as defined by the claims that follow.

The invention claimed is:

1. A heated roller for a textile printer, comprising:

a pair of stationary supports;

an elongated tubular element located between said stationary supports and rotatably carried by said stationary supports about a longitudinal axis;

a stationary infrared lamp extending inside said tubular element and having opposite ends supported by said stationary supports;

a lamp support device extending between said stationary supports inside said tubular element and supporting the infrared lamp between said stationary supports; and an elastic device which applies an elastic tension to said lamp support device between said stationary supports in the direction of said longitudinal axis.

2. A heated roller according to claim 1, wherein said lamp support device has side ends extending through hollow pins of said tubular element.

3. A heated roller according to claim 1, wherein said lamp support device has a first end connected to the first stationary support by means of said elastic device and a second end anchored to the second stationary support.

4. A heated roller according to claim 1, wherein said lamp support device comprises two parallel metal cables extending inside said elongated element parallel to said longitudinal axis.

5. A heated roller according to claim 4, wherein said lamp support device comprises a plurality of support elements fastened to said cables and spaced apart along said longitudinal axis.

6. A heated roller according to claim 4, wherein said elastic device comprises a pair of compression helical springs, each of which is compressed between said first stationary support and one end of a respective cable.

7. A heated roller according to claim 4, wherein each of said cables is provided at its ends with threaded cable terminals, wherein a first cable terminal extends within a respective helical compression spring of said elastic device at said first stationary support and the second cable terminal is anchored to the second stationary support.

8. A heated roller according to claim 1, wherein said stationary supports carry respective bearings which rotatably support said tubular element and comprise respective bases which support respective ends of said infrared lamp.

9. A textile printer comprising:

an in-line thermosetting unit including a heated roller having:

a pair of stationary supports, an elongated tubular element located between said stationary supports and rotatably carried by said stationary supports about a longitudinal axis, a stationary infrared lamp extending inside said tubular element and having opposite ends supported by said stationary supports, a lamp support device extending between said stationary supports inside said tubular element and supporting the infrared lamp between said stationary supports, and an elastic device which applies an elastic tension to said lamp support device between said stationary supports in the direction of said longitudinal axis.

* * * * *